United States Patent [19]

Altman

[11] Patent Number: 4,614,138

[45] Date of Patent: Sep. 30, 1986

[54] CUTTER FOR PLASTER BOARD AND THE LIKE

[76] Inventor: James E. Altman, P.O. Box 334, Gray, Ga. 31032

[21] Appl. No.: 738,842

[22] Filed: May 29, 1985

[51] Int. Cl.[4] ..... B26D 3/08

[52] U.S. Cl. ..... 83/51; 83/495; 83/873; 83/885; 125/23 T

[58] Field of Search ..... 83/493, 495, 885, 51, 83/873; 125/23 T

[56] References Cited

U.S. PATENT DOCUMENTS

| | | | |
|---|---|---|---|
| 647,053 | 4/1900 | Underwood . | |
| 898,259 | 9/1908 | Preston . | |
| 2,664,950 | 1/1954 | Morgan et al. | 83/495 X |
| 3,138,049 | 6/1964 | Flory et al. . | |
| 3,190,094 | 6/1965 | Kutas | 83/495 X |
| 3,786,706 | 1/1974 | Hyatt et al. . | |
| 4,024,784 | 5/1977 | Mueller | 83/495 X |

*Primary Examiner*—Donald R. Schran

*Attorney, Agent, or Firm*—Hill, Van Santen, Steadman & Simpson

[57] ABSTRACT

A cutter for sheet materials such as plasterboard and the like which employs a pair of axially spaced, copolanar circular blades with circumferential edges in adjacent noncontacting relationship. Both blades are driven but under conditions such that an edge speed differential exists between the blades. Supported sheet material is passed between the nip region between the blades to effectuate cutting. During cutting, the sheet material is self-propelled through the nip region by the action of the blades. Very little dust is produced during such sheet cutting.

13 Claims, 8 Drawing Figures

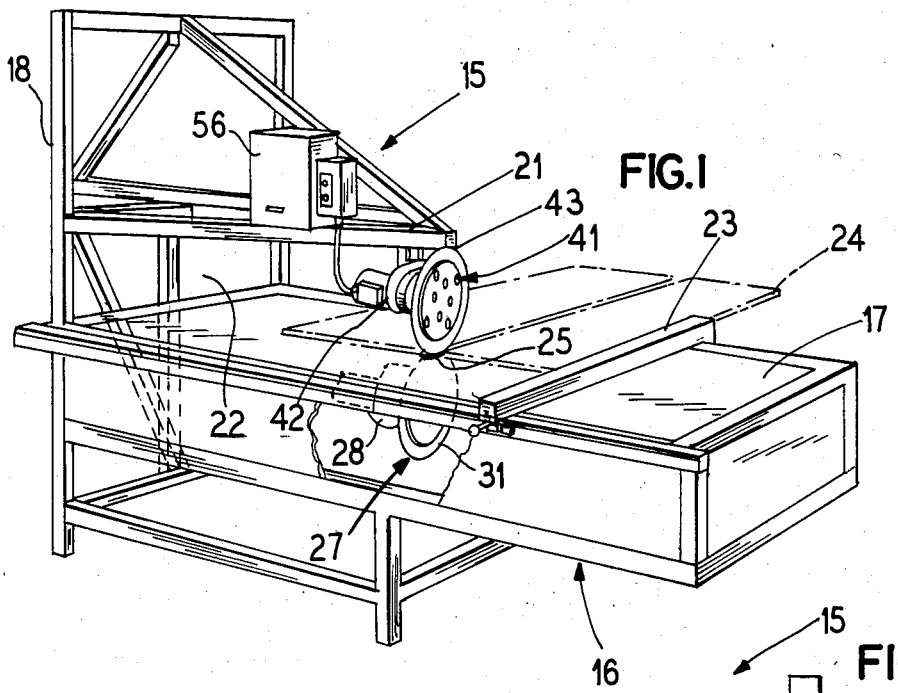
FIG.1
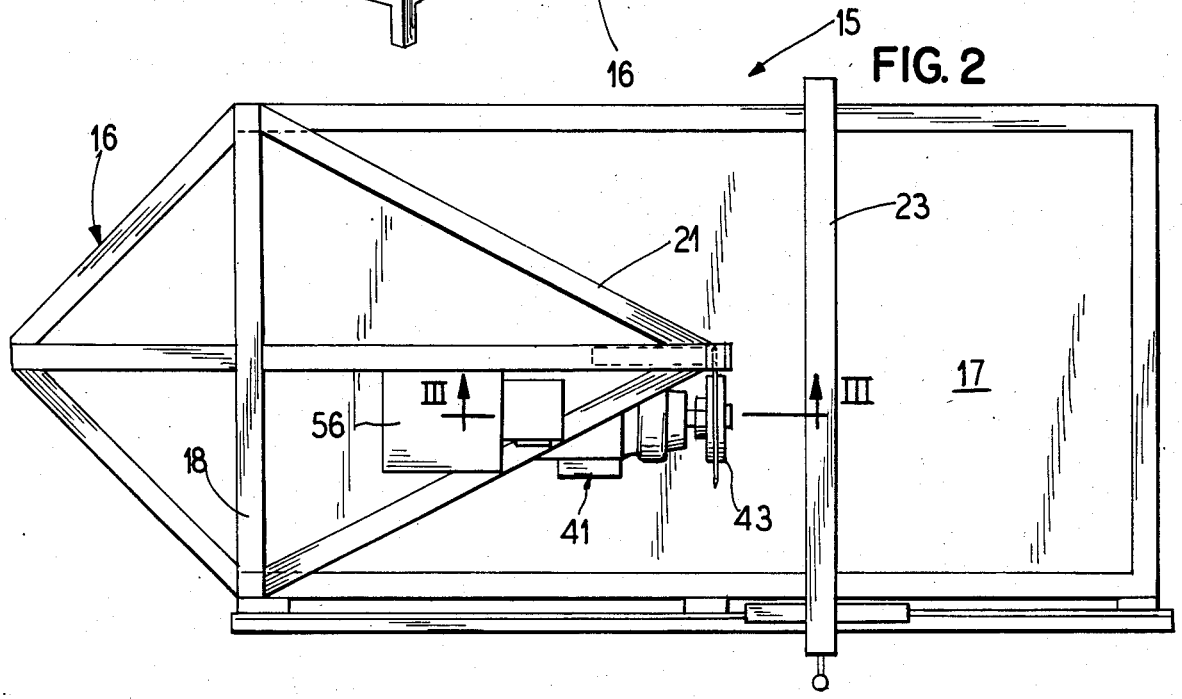
FIG. 2
FIG.7
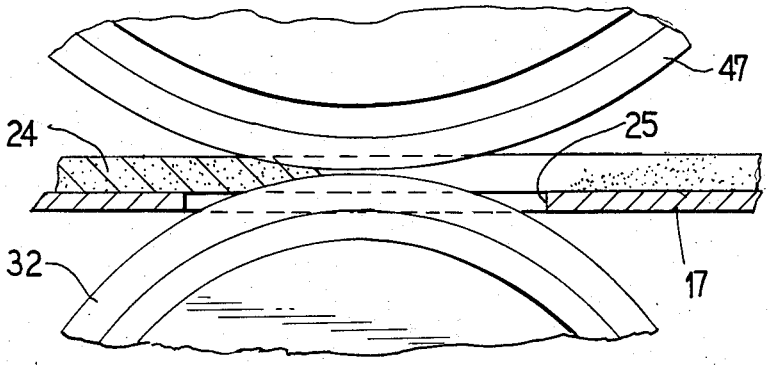

FIG.4
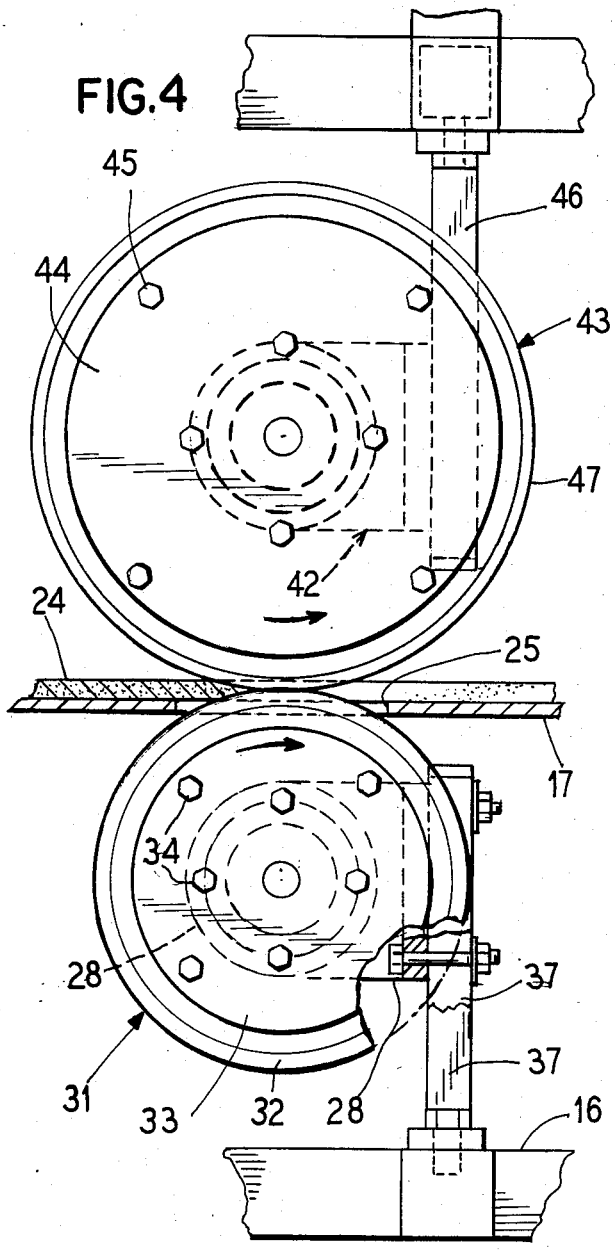
FIG.6
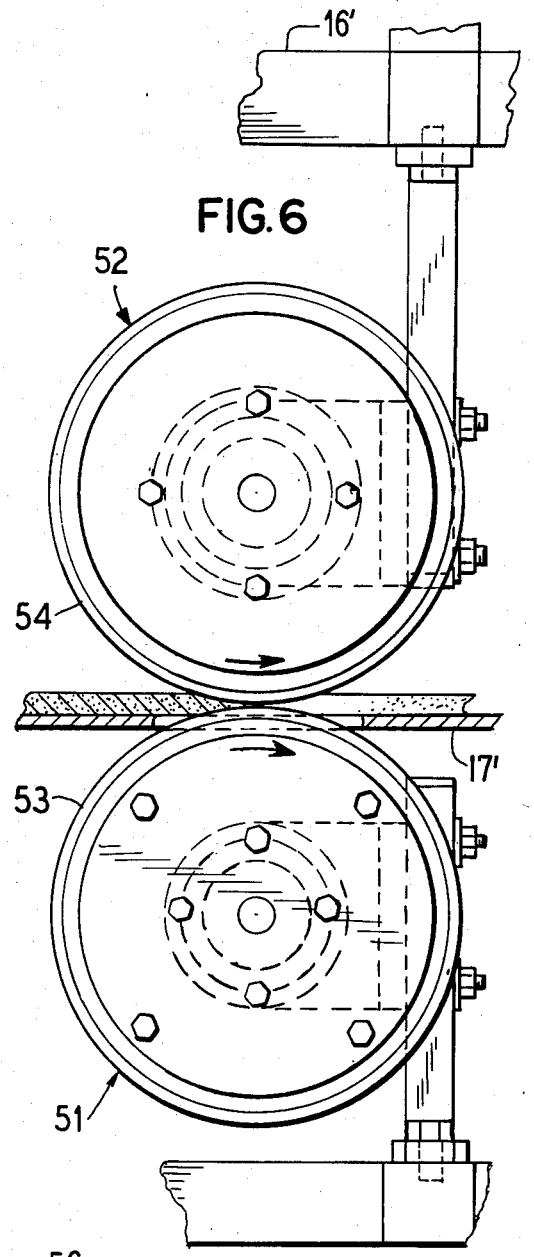
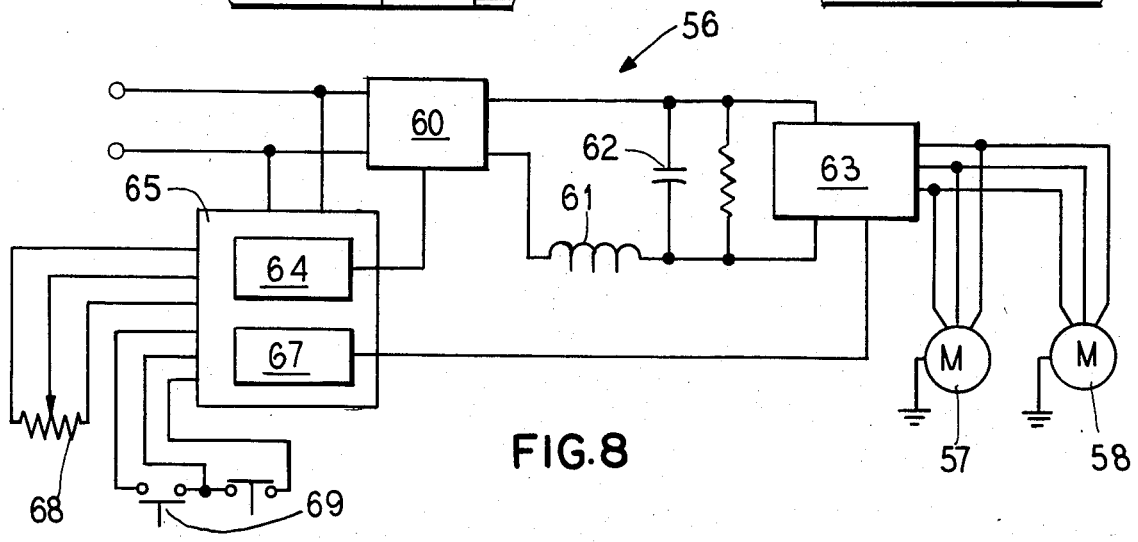
FIG.8

CUTTER FOR PLASTER BOARD AND THE LIKE

BACKGROUND OF THE INVENTION

1. Field of the Invention

This invention lies in the field of cutter apparatus for sheet materials, such as plaster board, and the like.

2. Prior Art

Cutting machines which employ a pair of cooperating opposed rotary disc knives adapted to form coinciding grooves on opposite sides of a sheet have been disclosed heretofore. For example, Preston U.S. Pat. No 898,259 (1908) teaches such an apparatus, but in Preston pressure roll means are employed in combination with his knives to compact material in the processed sheet which has been displaced by the action of the knives. The Preston knives are not driven and his apparatus is "especially designed for cutting material for making patterns which are . . . irregular in outline . . . F" (p.2, col. 1, lines 43–46 of Preston).

Underwood U.S. Pat. No. 647,053 (1900), Flory et al U.S. Pat. No. 3,138,049 (1964) and Hyatt et al U.S. Pat. No. 3,786,706 (1974) apparently teach cutting apparatus utilizing rotatable disc cutter pairs in combination with means causing individual cutters of a pair operate at differential rotational speeds. However, in such apparatus, the edges of each blade pair overlap, producing complete excision in cutting. Moreover, the sheet material being cut, such as wallpaper or the like, is evidently not self advanced by the cutting blade pair in a cutting operation.

Cutter apparatus which employs a pair of axially spaced, coplanar blades which are each driven in an opposite direction relative to the other under conditions such that a differential in peripheral blade edge speeds is maintained has not previously been known or suggested in this art, so far as is now known.

BRIEF SUMMARY OF THE INVENTION

More particularly, the present invention relates to cutter apparatus for cutting sheet materials, such as plasterboard, sheetrock, gypsum board, and the like.

The cutter apparatus permits one to make straight cuts through a pre-chosen such sheet material at precisely predeterminable locations. As cutting commences and progresses, the sheet material is moved forward into and through the cutting zone so that manual contact betweeen the sheet material being cut and the hands of an operator is completely avoidable after cutting commences.

Cuts are achieved using the cutter apparatus with little or almost no production of dust, such as is commonly associated with conventional prior art cutting devices, such as those which employ rotating saw blades, or the like.

The cutter apparatus employs a pair of rotatably driven smooth-edged preferably edge sharpened circular blades arranged so that the respective blades are substantially coplanar with the spatial distance between respective blade edges being minimized. The blades and/or the blade driving means are so chosen and/or operated that a peripheral blade speed differential exists between the respective blade members during cutter apparatus operation.

In a preferred form, the cutter apparatus employs variably powered blade drive means so as to permit an operator to select desired blade rotational speeds, thereby to adjust a sheet material cutting rate and sheet movement rate.

The cutter apparatus makes possible rapid, accurate cuts of highest possible quality and accuracy.

The cutter apparatus is reliable, economical, easy to service, and safe to personnel.

Particularly with sheet materials such as plaster board and the like, the blades in the cutter apparatus do not appear to become dull, so that one set of blades has an indefinitely long duty life.

In one preferred form, one blade of the blade pair has a larger diameter than the other, and each blade is driven by an independent but identical powerhead. The smaller diameter blade is preferably located below the larger diameter blade.

In another preferred form, both blades of the blade pair have substantially an identical diameter, but one blade is driven at a somewhat higher number of revolutions per minute than the other. The blade revolving at the faster rate is preferably located over the blade revolving at the lower rate. Such a differential in rotational speed is achievable by employing, for example, either a different power supply to each of two identical blade driving motors (one for each blade), or a pair of driving motors (one for each blade) which differ from each other by developing different revolutions per minute from the same power supply.

The present invention also relates to an improved process for making straight cuts in sheet materials, such as plaster board and the like. The process involves the use of the aforereferenced differentially rotating circular cutter blades with sheet support means. The process is largely dust free, accurate, and can be carried out, if desired, at high speeds. Sheet materials are self-advanced in a cutting operation.

Various other objects, aims, features, purposes, advantages, practices, embodiments, and the like will be apparent to those skilled in the art from the teachings of the present specification taken in combination with the drawings.

BRIEF DESCRIPTION OF DRAWINGS

In the drawings,

FIG. 1 is a perspective view of one embodiment of cutter apparatus of the present invention;

FIG. 2 is a plan view of the embodiment shown in FIG. 1;

FIG. 4 is a fragmentary vertical sectional view taken along the line IV—IV of FIG. 3;

FIG. 6 is a fragmentary vertical sectional view taken along the line VI—VI of FIG. 5;

FIG. 7 is a fragmentary enlarged area view taken through the cutting or nip region shown, for example, in FIG. 4; and FIG. 8 is a schematic electrical diagram illustrating one embodiment of circuitry suitably for use in the embodiment shown in FIGS. 5 and 6.

DETAILED DESCRIPTION

Figure 3:
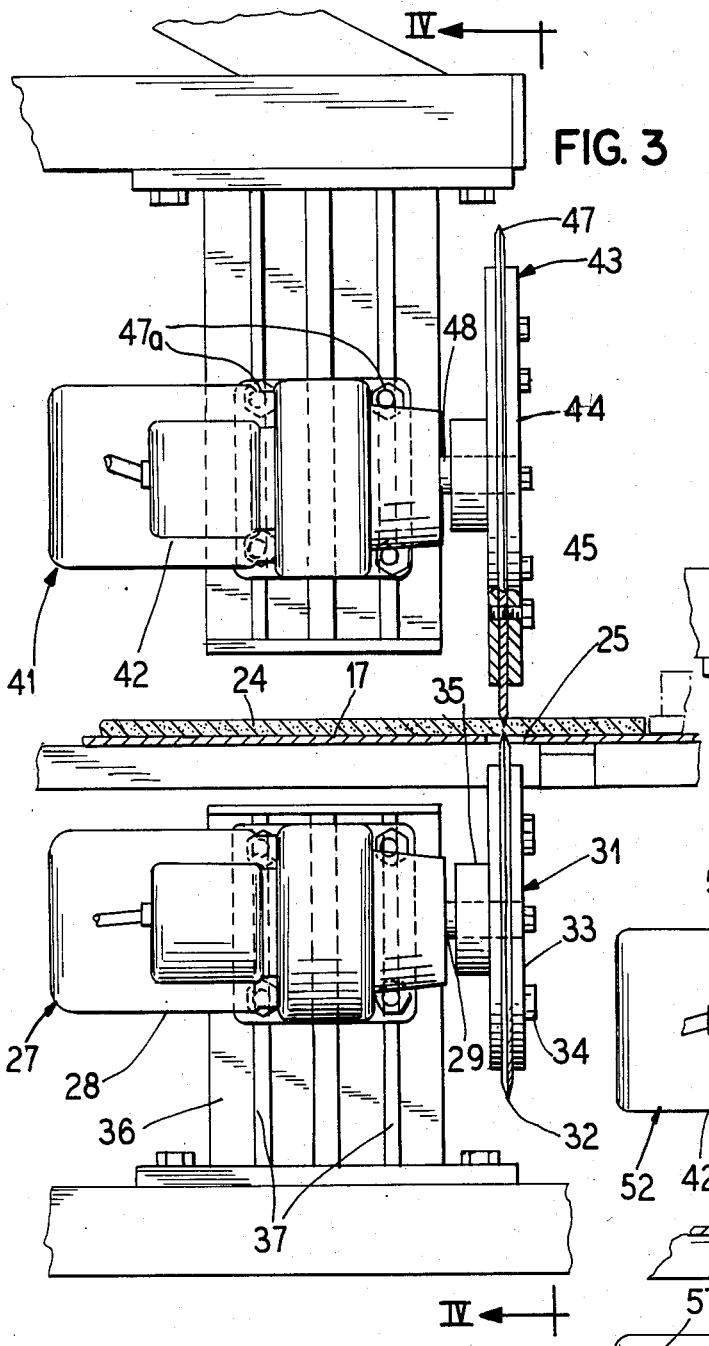
FIG. 3 is a fragmentary vertical sectional view taken along the line III—III of FIG. 2.

Referring to FIGS. 1 through 4 and 7, there is seen a cutter apparatus 15 of this invention which employs a frame assembly 16 that incorporates an integral table 17. Table 17 comprises a peripheral supporting frame comprised of angle iron or the like which supports a central surface that is in form of a metal plate or the like. The frame assembly 16 further includes an upstanding frame portion 18 at one side of the assembly 16. A horizontally extending boom 21 projects from the upstanding frame portion 18 over central portions of the table 17, thereby to provide an open throat region 22 between the bottom of the boom 21 and the surface of table 17. Thus, a sheet material to be cut is positioned and supported for cutting beneath the boom 21 in the cutter 15. Individual members of frame assembly 16 can be fastened together by means of welding or the like.

The table 17 is preferably provided with a sheet material edge guiding fence means 23 of which a preferred form is as more particularly described in my copending U.S. patent application filed on even date herewith, such application now being identified by U.S. Ser. No. 738,828, filed 5/29/85. The fence means 23 in combination with the cutter apparatus 15 permits one to guide and position a sheet piece 24 for cutting. Sliding contact between an edge of sheet piece 24 and fence means 23, and between table 17 and sheet piece 24, occurs as such sheet piece 24 is being cut by the cutter apparatus 15. The fence means 23 extends transversely across the cutting table 17 with edge-contacting side surface portions thereof being parallel to the cutting direction.

A slot 25 is formed in the table 17 and extends in a direction generally parallel to the cutting direction. Mounted on the frame assembly 16 beneath the surface of the cutting table 17 is a lower cutting assembly 27. Such assembly 27 includes a motor drive and an integrally associated gear reducer, such combination being designated in its entirety by the numeral 28. The output shaft 29 of such motor/gear combination 28 has keyed thereto a cutter blade assembly 31. This assembly 31, as shown, preferably has a (preferably) replaceable circular blade 32 mounted face to face between a pair of mounting discs 33. One of the two mounting discs 33 is integrally joined with a hub 35 while the other mounting disc 33 is positioned and held in engagement with the blade 32 in the assembled blade assembly 31 by means of machine screws 34 or the like. The blade 32 has a sharpened, tapered (on each blade side) edge circumferentially extending thereabout.

A mounting bracket 36 supports the cutter blade assembly 31. The bracket 36 is provided with a pair of adjustable clearance slots 37 through which nut and bolt assemblies are extended and mounted, thereby to provide adjustability for vertically translating and positioning the cutter blade assembly 31. Preferably, the peripheral edge portions of the blade 32 are located in such a position that edge portions of the blade not only extend through the slot 25 but also extend there beyond by a distance which is preferably approximately equal to about one-half the thickness of the particular sheet piece 24 being cut by the cutter assembly 15.

Suspended from the boom 21 is an upper cutting assembly 41 which, like lower cutting assembly 27, includes a motor drive and integrally associated gear reducer assembly, such moto/gear combination being designated in its entirety by the numeral 42. The output shaft 48 of such combination 42 has keyed thereto a 48 cutter blade assembly 43. Similarly to cutter blade assembly 31, the cutter blade assembly 43 incorporates a (preferably) replaceable circular blade 47 which is mounted between a pair of mounting discs 44 by means of machine screws 45. Similarly to the blade 32, the blade 47 is tapered on each blade side around its sharpened circumferential edge regions, as shown. However, the diameter of the blade 47 is larger than the diameter of the blade 32.

A mounting bracket 46, like mounting bracket 36, is employed in combination with nut and bolt assemblies **47*a* to vertically adjustably translate and position the upper cutter blade assembly 43** in a desired location.

The upper cutter blade assembly 43 is so located spacially as to have the blade 47 of the cutter blade assembly 43 be essentially coplanar with the blade 32. Thus, the axis of the shaft 29 is substantially parallel to the axis of the shaft 48.

The blades 32 and 47 are so positioned with respect to one another that the spacing between the respective peripheral circumferential edges of each blade is as close as possible without effecting my contact therebetween during operation of the respective blade assemblies 31 and 43. Blade 47 is so positioned as to penetrate approximately one-half of the thickness of the sheet piece 24 (like blade 32). The plane of the blades 32 and 47 defines the cutting direction.

In the cutter apparatus 15, the motor combination 42 is substantially identical to the motor combination 28 so that each respective output shafts 48 and 29, rotates in operation at a substantially identical number of revolutions per minute from the same power supply. However, owing to the differential in diameters of the respective blades 32 and 47, the peripheral speed of the blade 47 is appreciably greater than the peripheral speed of the blade 32.

In general, the relationship between blades and the speed differential between respective edges of blades 32 and 47 is at least about 50 feet per minute peripheral blade edge speed at about 200 revolutions per minute.

Typical rotational speeds for the shafts 29 and 48 can range from about 50 to 200 rpm, depending upon the cutting speed desired by an operator. Preferably, the rotational speed is infinitely variable, such as is achieved by a frequency controller (not shown) in the power supply feeding the electric motors of combinations 28 and 42. A suitable such frequency controller is available commercially, such as from the Parametrics Company under its trademark "FHP PARAJVST".

In operation, once a sheet piece 24 has been moved into position and has entered into the cutting or nip region between the adjacent tip edge regions of the revolving respective blades 32 and 47, the sheet piece 24 is moved forwardly being self-propelled by the frictional engagement of portions of the work piece 24 with peripheral edge regions of the respective blades 32 and 47. Thus, the cutter apparatus 15 provides a self feeding feature for a sheet piece 24. In general, the advance speed of a sheet piece 24 is approximately equal to a value defined by one-half the peripheral blade edge speed differential plus the peripheral blade edge speed of the smaller diameter blade (that is, blade 32 in cutter 15).

Figure 5:
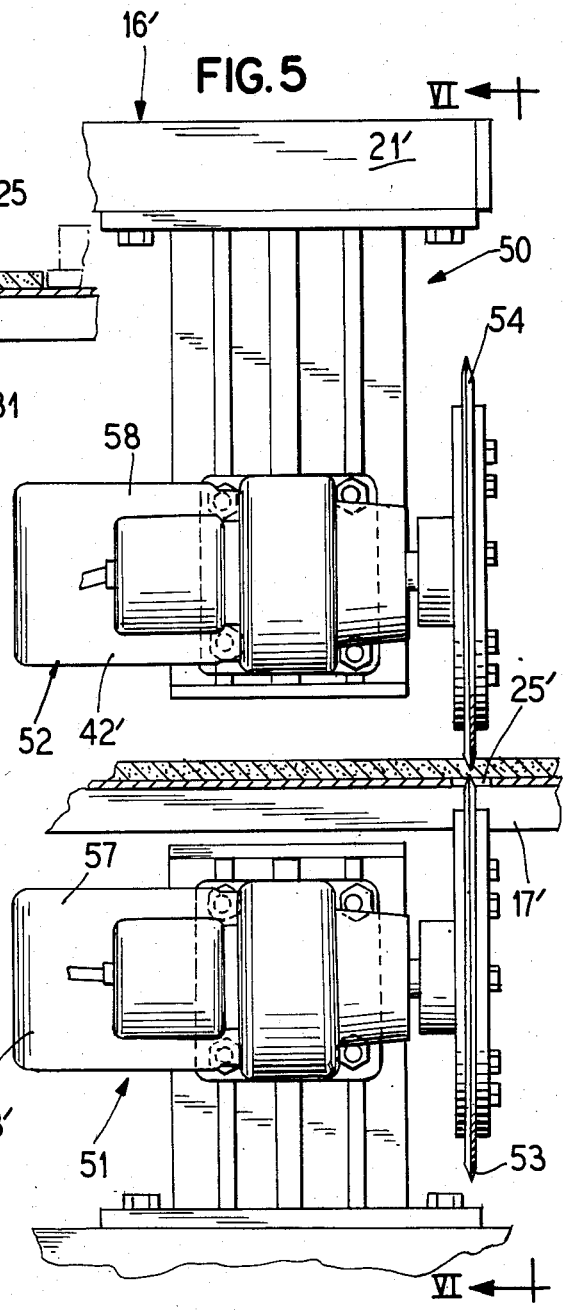
FIG. 5 is a fragmentary view similar to FIG. 3 of an alternate embodiment of cutter apparatus of the present invention.

Referring to FIGS. 5 and 6, there is seen another cutter apparatus 50 of this invention which employs a frame assembly 16' which frame assembly 16' is similar to the frame assembly 16 utilized in cutter apparatus 15 above described. Parts of the frame assembly 16' which correspond to similar parts in frame assembly 16 are similarly numbered but with the addition of prime marks thereto for convenience.

Like cutter apparatus 15, cutter apparatus 50 preferably employs a fence means which can be similar to the fence means 23 of cutter apparatus 15.

Mounted on the frame assembly 16' beneath the surface of the cutting table 17' is a lower cutting assembly 51 which is similar in construction and operation to the lower cutting assembly 27 of cutter apparatus 15.

Suspended from the boom 21' is an upper cutting assembly 52 which is similar to upper cutting assembly 41. Lower cutting assembly 51 employs a replaceable circular blade 53 which is identical in diameter to a replaceable circular blade 54 employed in upper cutting assembly 52. The motor drive and associated gear reducer combination 28' employed in lower cutting assembly 51 is here substantially identical to the motor drive and gear reducer assembly combination 42' employed in upper cutting assembly 52.

In order to produce the desired differential in peripheral speeds between respective blades 53 and 54 during operation of cutter apparatus 50, a suitable controller means is employable. Illustrated, schematically in FIG. 8 is a variable speed drive arrangement for driving a pair of blades, such as blades 53 and 54, or blades 32 and 47. With this drive arrangement, blade speeds can be varied but each blade with this drive arrangement is driven at the same r.p.m., as is shown by the following description:

In FIG. 8, there is seen a controller 56 which is adapted for motor speed control using three-phase 230 VAC motors such as those having a horsepower rating up to approximately $\frac{3}{4}$. Controller 56 furnishes variable frequency and variable voltage to convert fixed 230 volt AC motors 57 and 58 (of, respectively, combinations 28' and 42') into variable speed motors. In the controller 56, as the frequency is increased, the voltage is also increased. This maintains constant motor torque.

In controller 56, single-phase 230 VAC power is converted to variable voltage DC power by the DC power module 60. The variable voltage DC power is then smoothed out by the filter choke 61 and the filter capacitors 62. This power is then converted into three-phase AC power by the transistor module 63. The operation of SCRs (Selenium Controlled Rectifiers) in the power module 60 is controlled by the control module 64 in motherboard 65. The control module 64 also sequences the driver module 67 in motherboard 65 and controls an automatic reversing function.

The driver module 67 switches the transistors in the transistor module 63 to develop three-phase variable frequency power. The correct voltage to frequency relationship is maintained by the control module 64.

The controller 56 does not start the motors 57 and 58, it accelerates them. When power is supplied to the controller 56 the output frequency rises from 0 frequency to a frequency set by a speed control potentiometer 68. The rate of frequency rise is adjustable, for example, from about 1.5 to 15 seconds, by the potentiometer 68. High starting currents are avoided by controlled acceleration as opposed to across the line starting of the motors.

When the potentiometer 68 setting is changed, the controller 56 will accelerate or decelerate by the rate set by the potentiometer 68. Controlled acceleration and deceleration is thus furnished at all times.

When the power is removed from the controller 56, as by pushing a normally closed stop button 69, for example, the controller 56 ceases operating and the motors coast to a rest. Conveniently, the controller 56 produces an output ranging from about 0 to 120 Hertz. A suitable controller 56 is available commercially such as under the trademark (FHP Parajust from Parametrics, a unit of Barry Wright Corp.).

By this arrangement, the frequency supplied to both motors is varied to achieve a particular cutting speed. Each motor has the same power supply.

In an alternative arrangement (not shown), in place of motors 57 and 58, one can employ a pair of motors in combination. These motors are provided with control means so that they can be operated at different speeds relative to one another in order to achieve desired differences in output shaft r.p.m., thereby to achieve a desired speed differential between the respective blades 54 and 53. Preferably, in this arrangement, a frequency controller is employed so that the power supplied to the motors 42' and 28' can be varied, thereby to permit an operator to adjust cutting speed. A suitable frequency controller is available commercially under the trademark "FHP PARAJVST" from the Parametrics Company.

EMBODIMENTS

The present invention is further illustrated by reference to the following examples. Those skilled in the art will appreciate that other and further embodiments are obvious and within the spirit and scope of this invention from the teachings of these present examples taken with the accompanying specification.

EXAMPLE 1

Cutter apparatus as shown in FIGS. 1–4 and 7 is constructed wherein each motor of combination 28 and 42 is a three-phase 230 VAC motor rated at 100 rpm. Upper blade 47 has a diameter of 13 $\frac{1}{2}$ inches while lower blade 32 has a diameter of 10 inches. The resulting cutter apparatus cuts plasterboard at a rate of about 150 feet per minute.

However, it is found that the sliding friction from employment of a conventional fence employing a paint covered stationary sliding surface was sufficient to impair achievement of the 150 feet per minute cutting speed. However, when the fence employed employs rollers therein as described in my copending application above referenced filed on even date herewith and identified by U.S. Ser. No. 738,828, filed 5/29/85 problem of sliding friction is eliminated and the cutting speed of 150 feet per minute and higher is obtained.

EXAMPLE 2

Cutter apparatus as shown in FIGS. 1–4 and 7 is constructed wherein each motor of the respective combinations 28 and 42 is a three-phase 230 VAC motor rated at 100 rpm. Upper blade 47 has a diameter of 13 $\frac{1}{2}$ inches while lower blade 32 has a diameter of 10 inches. The cutter apparatus is additionally equipped with a frequency regulator that allows motor speed control in the range of 0 to about 200 rpm. This cutter apparatus provides a top cutting speed of about 600 feet per minute for plasterboard and the like. At this speed, an 8 foot cut is accomplished in 0.6 seconds. The frequency regulator employed has a structure similar to that above described for controller 56 and is available commercially from Parametrics Division of Barry Wright Corporation as FHP Parajust model 6007.

EXAMPLE 3

Cutter apparatus as shown in FIGS. 5,6 and 8 is constructed. Upper motor 58 employs a 230 VAC motor rated at 49 rpm while lower motor 57 is a 230 VAC motor rated at 29 rpm. Upper blade 54 and lower blade 53 each have a diameter of 9 ½ inches. The circumferential edge or tip of the top blade 54 is traveling at a speed of (49 revolutions per minute times 9.5 Pi inches per revolution times 12 inches) or 122 feet per minute. The circumferential edge or tip of the bottom blade has a traveling speed of 29/49 (122) or 72 feet per minute. The difference of 50 feet per minute is an optimum rate that is confirmed with SCR speed controlled motors utilized in previous tests and experiments. This speed differential appears to represent an optimum ability to produce good scoring and separating of plasterboard, sheet rock, gypsum board, and the like.

The above and other variations in the details of the apparatus and its mode of use, which will readily occur to those skilled in the art, are all considered as encompassed within the compass of this invention, the scope of which is limited only as required by the appended claims.

I claim:

1. A cutter for sheet material comprising in combination:

(A) a pair of axially spaced coplanar circular blades having their respective circumferential edges in an adjacent but noncontacting relationship, thereby to define a nip region, (B) powerhead means for rotatably driving each of said blades, including shaft means axially associated with each of said blades, (C) means for rotating one of said blades at a higher edge speed than the other thererof, and (D) frame means for supporting such sheet material for passage through said nip region and for supporting said blade pair, said powerhead means, and said means for rotating.

2. The cutter of claim 1 wherein one of said blades is generally vertically oriented relative to the other thereof, and said frame means includes table means for so supporting such sheet material for such passage in a generally horizontal direction.

3. The cutter of claim 2 wherein a position-adjustable edge guidance means is associated with said table means for contact with edge portions of such sheet material during operation of said cutter.

4. The cutter of claim 3 wherein said edge guidance means is provided with sliding friction elimination means.

5. The cutter of claim 1 wherein said means for rotating is provided by having one of said blades possess a larger diameter than the other thereof which each of said blades is associated with an independent but identical said powerhead means.

6. The cutter of claim 1 wherein said means for rotating is provided by having each of said blades possess the same diameter while the powerhead associated with one of said blades has a higher revolution per minute output than the powerhead associated with the other of said blades for a given power input.

7. The cutter of claim 1 wherein said means for rotating results in a blade edge speed differential which is about 50 feet per minute.

8. The cutter of claim 1 which is additionally provided with power regulation means for varying rotational speeds of said powerhead means.

9. The cutter of claim 8 wherein said power regulation means comprises a frequency regulator that allows motor speed control over the range from 0 to 200 revolutions per minute.

10. A process for making straight cuts in sheet material such as plasterboard and the like comprising the steps of:

(A) supporting such a sheet material, (B) introducing an edge of such sheet material into the nip region existing between a pair of axially spaced coplanar circular blade members which have their respective circumferential edges in an adjacent but noncontacting relationship, said nip region being located about in the middle of such edge by said supporting (C) rotating said blade members while maintaining a blade edge differential speed between said blade members (D) permitting such sheet material after said introducing to travel through said nip region.

11. The process of claim 10 wherein said supporting is provided by table means in sliding contact with a lowermost face of said sheet material.

12. The process of claim 11 wherein said supporting is further provided by fence means with which an edge of said sheet material is in sliding contact, said fence means extending in a direction which is parallel to the cutting direction produced by said pair of blade members.

13. The process of claim 12 wherein said fence means provides a substantially friction-free surface relative to said sheet material edge.

* * * * *